US008177191B2

(12) United States Patent
Liou

(10) Patent No.: US 8,177,191 B2
(45) **Date of Patent: *May 15, 2012**

(54) MULTI-FUNCTION TOOL

(76) Inventor: Mou-Tang Liou, Ta Li (TW)

( * ) Notice: Subject to any disclaimer, the term of this patent is extended or adjusted under 35 U.S.C. 154(b) by 1003 days.

This patent is subject to a terminal disclaimer.

(21) Appl. No.: 12/139,560

(22) Filed: Jun. 16, 2008

(65) Prior Publication Data

US 2009/0307848 A1 Dec. 17, 2009

(51) Int. Cl.

| | |
|---|---|
| ***B25C 11/00*** | (2006.01) |
| ***B66F 15/00*** | (2006.01) |
| ***B66F 3/00*** | (2006.01) |
| ***B25B 13/12*** | (2006.01) |
| ***B25F 1/00*** | (2006.01) |

(52) U.S. Cl. ..... 254/25; 254/115; 254/130; 254/21; 81/129; 7/139

(58) Field of Classification Search ..... 254/250, 254/115, 116, 130, 18, 21, 25, 26 E; 7/139, 7/143, 166; 81/129, 154, 177.1, 177.85, 81/489, 491; D8/89

See application file for complete search history.

(56) References Cited

U.S. PATENT DOCUMENTS

| | | | | |
|---|---|---|---|---|
| 404,001 | A | 5/1889 | Heacock | 7/139 |
| 540,967 | A | 6/1895 | Eveleth | 254/26 E |
| 780,305 | A | 1/1905 | Riggin | 81/144 |
| 856,097 | A | 6/1907 | Palmer | 254/26 E |
| 885,363 | A | 4/1908 | Myers | 81/145 |
| 1,132,879 | A | 3/1915 | Rairden | 254/26 E |
| 1,402,470 | A * | 1/1922 | Bauer | 30/429 |
| 2,638,244 | A * | 5/1953 | Carroll | 220/274 |
| 2,876,776 | A * | 3/1959 | Williams | 606/1 |
| 3,219,316 | A * | 11/1965 | Fried | 254/131 |
| 3,629,883 | A * | 12/1971 | Norman | 7/170 |
| 3,852,839 | A * | 12/1974 | Blessing | 7/100 |
| 5,044,033 | A * | 9/1991 | Fosberg | 7/166 |
| 5,249,776 | A | 10/1993 | Johnson | 254/26 E |
| 5,845,354 | A | 12/1998 | Long et al. | 7/139 |
| 6,058,814 | A | 5/2000 | Johnson | 81/177.2 |
| 6,827,333 | B1 | 12/2004 | Lutz | 254/26 E |
| 7,063,168 | B2 * | 6/2006 | Paloheimo et al. | 172/378 |
| 7,735,172 | B2 * | 6/2010 | Newton et al. | 7/166 |
| 7,774,882 | B2 * | 8/2010 | Liou | 7/166 |
| 2004/0045416 | A1 | 3/2004 | Liou | 81/177.1 |
| 2009/0008614 | A1 * | 1/2009 | Adams et al. | 254/25 |
| 2009/0050861 | A1 | 2/2009 | Noah et al. | |
| 2009/0307847 | A1 | 12/2009 | Liou | |

* cited by examiner

*Primary Examiner* — Lee D Wilson
*Assistant Examiner* — Alvin Grant
(74) *Attorney, Agent, or Firm* — Alan Kamrath; Kamrath IP Lawfirm, PA

(57) ABSTRACT

A multi-function tool comprises a shank body including a plurality of located grooves aligned thereon longitudinally; a pry bar including a first section, a second section extending from the first section for prying, a first receptacle longitudinally piercing the first section for slidably mounted on the shank body and two second receptacles transversely piercing the first section and in communication with the first receptacle; two clutches respectively disposed in the second receptacles for alternatively engaging with a selective one of the located grooves; and a foot hold disposed onto the bottom of the first receptacle; wherein the second end of the shank body is inserted through the first receptacle of the pry bar and installed to the foot hold, with the foot hold being able to rotate relative to the shank body.

25 Claims, 12 Drawing Sheets

MULTI-FUNCTION TOOL

BACKGROUND OF THE INVENTION

1. Field of the Invention

The present invention relates to a multi-function tool adapted for nail pulling and prying. More particularly, the present invention relates to a multi-function tool including a shank body and a pry bar adjustably mounted on the shank body.

2. Description of the Related Art

A conventional tool for nail pulling and prying material on the surface includes a pry bar formed on an end thereof and a handle formed on another end thereof. However, the tool is usually formed as one piece and the distance between the pry bar and the handle cannot be adjusted so that it causes that the tool is just adapted for pulling nails whose size is limited to a particular range, and if nail whose size is over the range, the tool could not pull out the nail fully. Moreover, when a user operates the tool to pry something on a narrow place, it is difficult to find a fulcrum for supporting.

Therefore, the present invention is intended to obviate or at least alleviate the problems encountered in prior art.

SUMMARY OF THE INVENTION

It is therefore an object of the present invention to provide a multi-function tool that includes a pry bar and a foot hold and is adapted to be adjusted the distance between the pry bar and the foot hold for clamping materials with various sizes.

Accordingly, the present invention provides a multi-function tool includes a shank body, a pry bar slidably mounted on the shank body longitudinally, two clutches coupling the pry bar to the shank body and a foot hold rotatably installed to the bottom of the pry bar and adapted for receiving an end of the shank body. The shank body includes a first end, a second end inserted through the pry bar and a plurality of located grooves aligned thereon from the second end to the first end. The pry bar includes a first section for engaging with a selective one of the located grooves, a second section for prying and two second receptacles transversely formed therethrough for receiving two clutches respectively, with each of the clutches adapted for fixing the pry bar to the selective one located groove so that the pry bar can be adjusted to a desired location on the shank body. The foot hold is disposed onto the bottom of the pry bar, and the second end of the shank body is inserted through the first receptacle of pry bar and then is installed to the foot hold, with the foot hold being able to rotate relative to the shank body.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
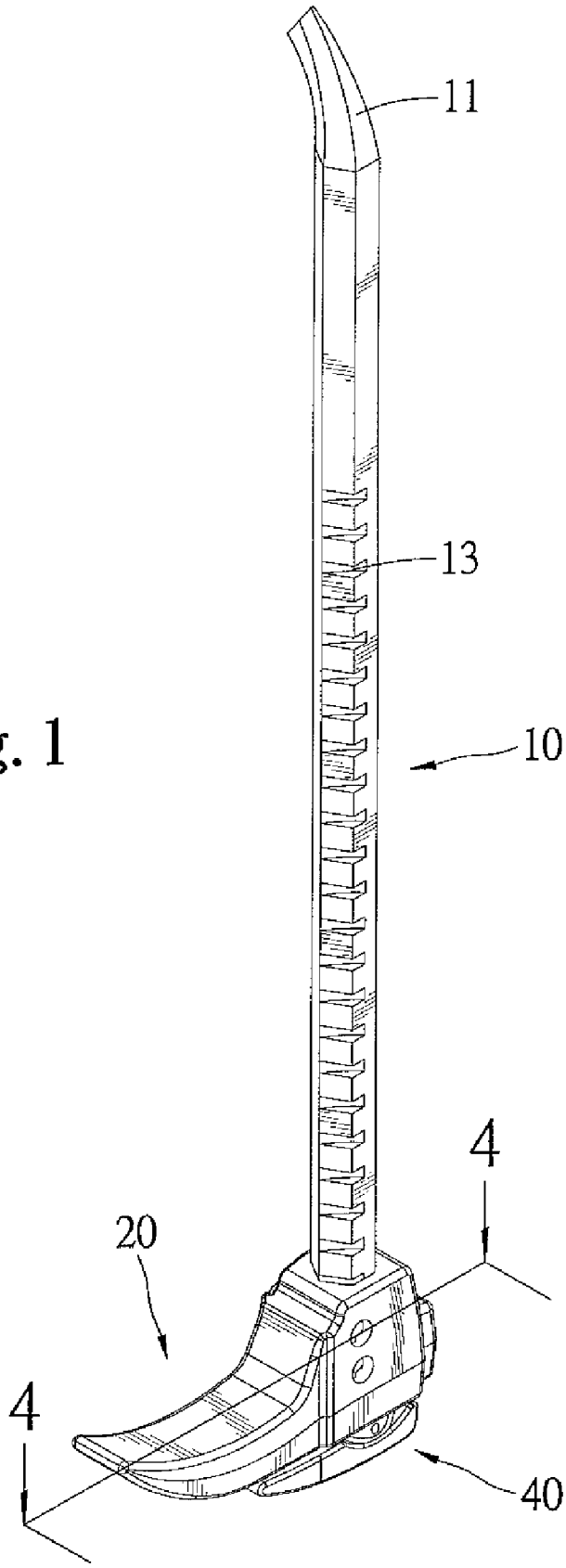
FIG. 1 is a perspective view of a multi-function tool according to the first embodiment of the present invention.
Figure 2:
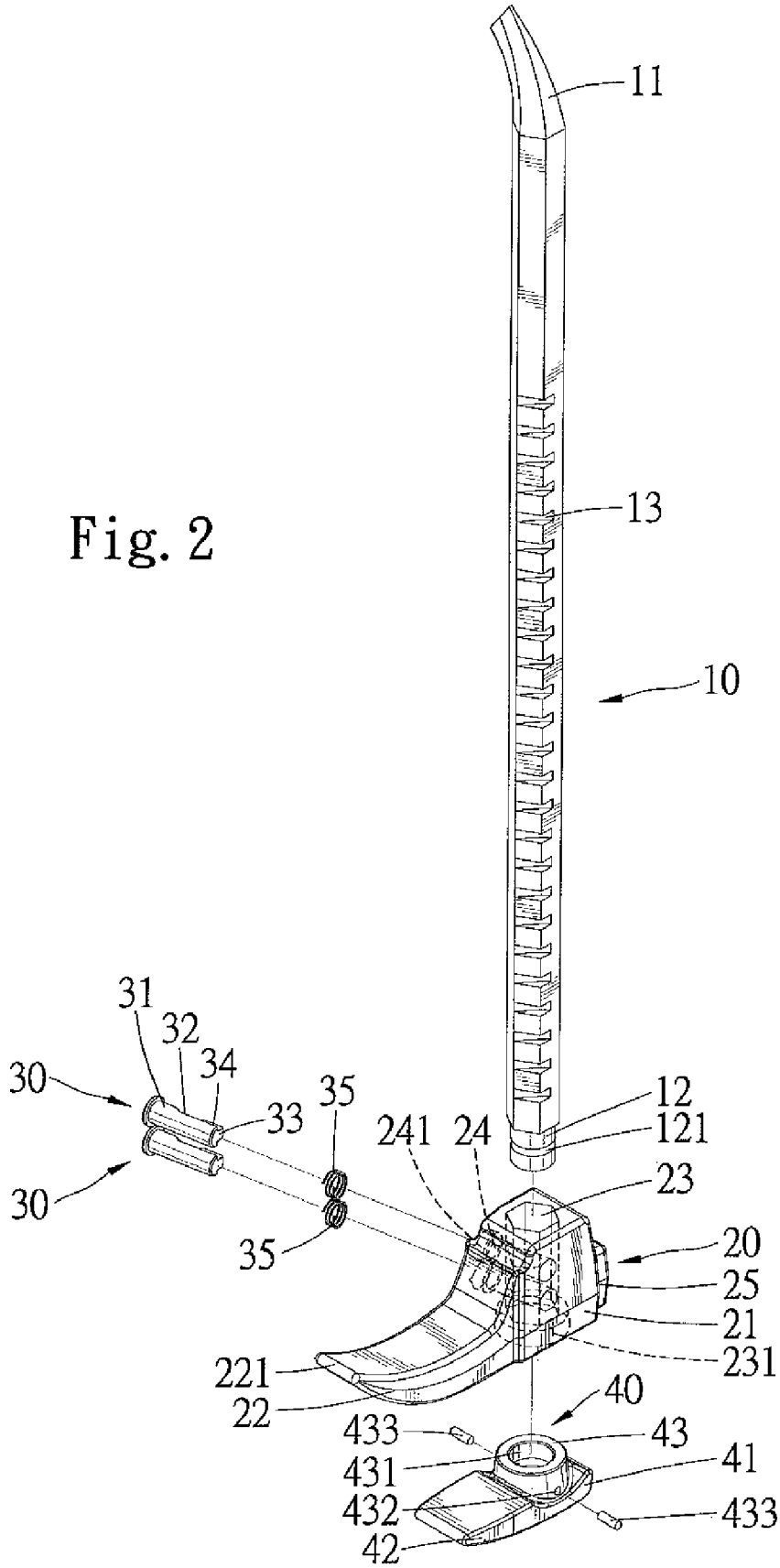
FIG. 2 is an exploded view of the multi-function tool shown in FIG. 1.
Figure 3:
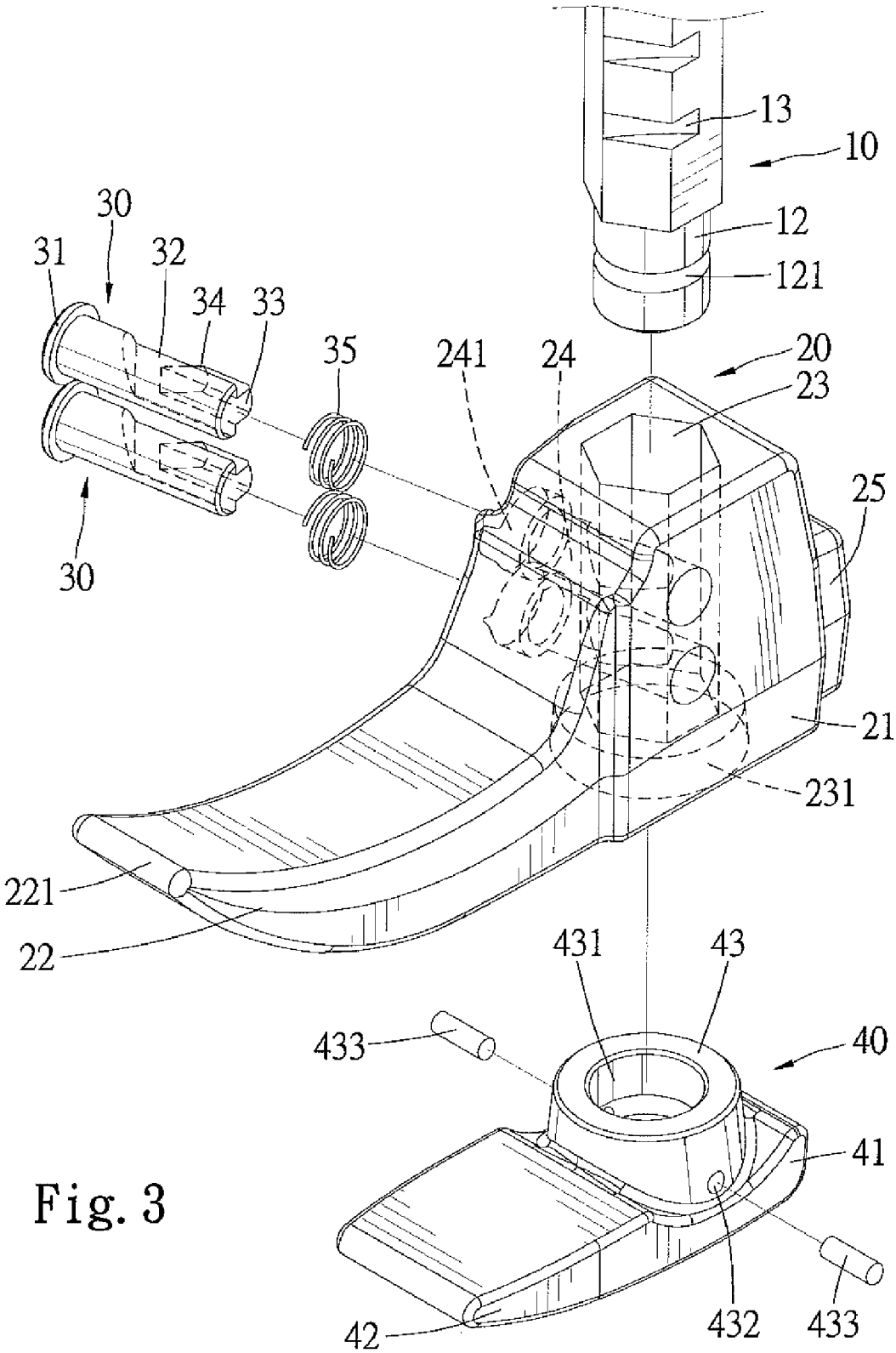
FIG. 3 is a partial enlarged view shown in FIG. 2.
Figure 4:
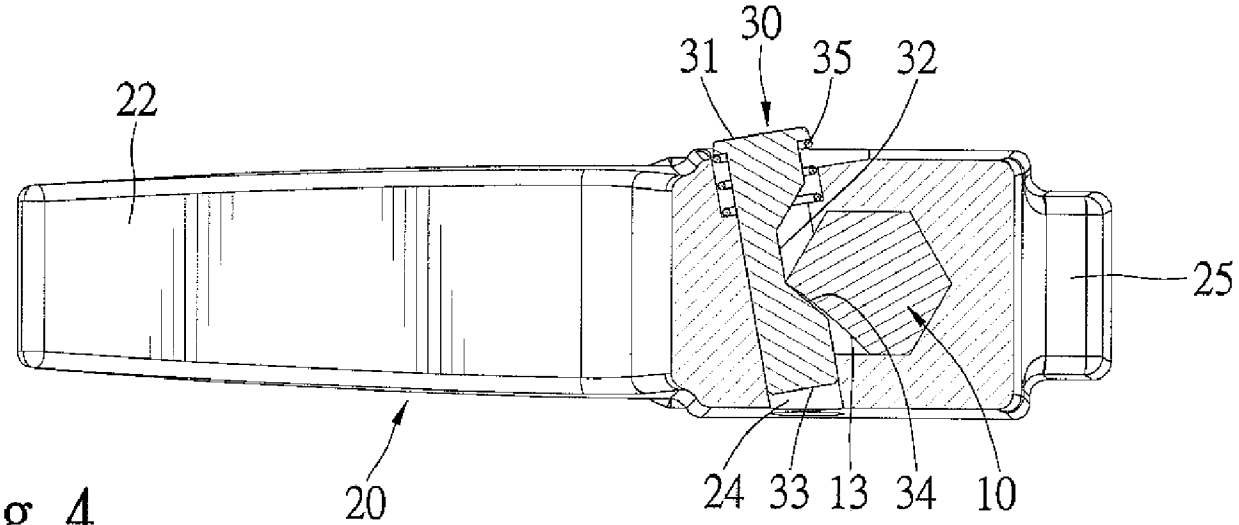
FIG. 4 is a cross-sectional view taken along 4-4 in FIG. 1.
Figure 5:
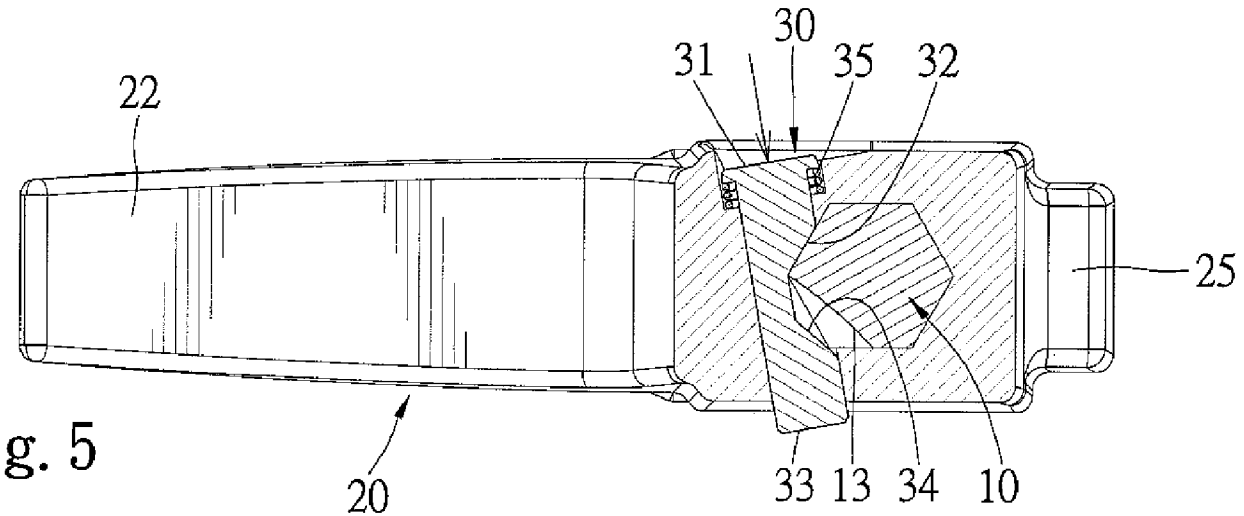
FIG. 5 is another cross-sectional view similar to FIG. 4, illustrating pressing the switch device to detach from one of the located grooves of the shank body.

Referring to FIGS. 1 through 6, a multi-function tool in accordance with a first embodiment in the present invention, the multi-function tool includes a hexagonal shank body 10, a pry bar 20 slidably mounted on the shank body 10 longitudinally, two clutches 30, each adapted to couple the pry bar 20 to the shank body 10 and a foot hold 40 installed to the bottom of the pry bar 20 and connected to the shank body 10.

The shank body 10 includes a first end 11 and a second end 12 opposite to the first end 11. The first end 11 is in form of a tip and adapted for loosening materials that are tightened together or breaking materials in an emergency. The second end 12 includes an engaging groove 121 formed thereon in position and adjacent to the distal end of the shank body 10. A plurality of located grooves 13 are defined on the outer periphery of the shank body 10, with the located grooves 13 aligned from the second end 12 to the first end 11, with the interval between each of the located grooves 13 alternatively being constant or not.

The pry bar 20 includes a first section 21 mounted on the shank body 10, a second section 22 extending from an end of the first section 21 and a terminal end 25 projecting from another end of the first section 21 opposite to the second section 22. A hexagonal first receptacle 23 pierces the first section 21, with the direction of axis of the first receptacle 23 being parallel to that of the shank body 10, with the inner periphery of the first receptacle 23 corresponding to the outer periphery of the shank body 10. A first limited end 231 is formed on the bottom of the first receptacle 23. Two second receptacles 24 transversely pierces the first section 21 and in communication with the first receptacle 23, with the direction of axis of each second receptacle 24 being perpendicular to that of the first receptacle 23 and that of the second section 22, respectively. A second limited end 241 is formed on an end of each second receptacle 24, with the second receptacles 24 being parallel to each other in a transverse direction, with the diameter of the limited end 241 being larger than that of the related second receptacle 24. A prying portion 221 is defined on the terminal end of the second section 22 for separating materials which are nailed or otherwise fastened together.

Each clutch 30 is in form of a column and disposed in the related second receptacle 24 to selectively engage with one of the located grooves 13 for fixing the pry bar 20 on the desired location of the shank body 10. Each of the clutches 30 includes a first end defining a flange 31 for abutting against the second limited end 241 and a second end defining a protrusion 33 for exactly inserting into the one of the located grooves 13. An abutted surface 34 is defined on a side of the protrusion 33 so that when the protrusion 33 is inserted to one of the located grooves 13, the abutted surface 34 just abuts with the inner wall of the located groove 13 for a secure engagement of the pry bar 20 and the shank body 10. A sunken portion 32 is provided between the first and second ends of each clutch 30 and then the shank body 10 is through the clutches 30 and is set in the first receptacle 23 of the pry bar 20 without contact with the clutches 30. Each of the clutches 30 farther includes an elastic element 35 mounted thereon and adjacent to the flange 31. When each of the clutches 30 is in an engaging position and the elastic element 35 is released, the protrusion 33 is engaged with the one of the located grooves 13 and the abutted surface 34 abuts with the inner wall of the located groove 13 (shown in FIG. 4). When each of the clutches 30 is a disengaging position and the elastic element 35 is pressed, the protrusion 33 is disengaged from the located groove 13 and the abutted surface 34 is spaced from the inner wall of the located groove 13 (shown in FIG. 5).

The foot hold 40 includes a first section 41 and a second section 42 opposite to the first section 41, with the second section 42 adapted for prying. A connective portion 43 is formed on the first section 41 and includes a compartment 431 defined therein and in communication with the first receptacle 23, two openings 432 formed on the outer periphery thereof and corresponding to the engaging groove 121 and two fasteners 433, each provided to insert through the related one of the openings 432 for engaging with the engaging groove 121 as to couple the foot hold 40 to the second end 12 of the shank body 10. In this embodiment, the shape of the first limited end 231 is preferably circular and corresponds to that of the top rim of the connective portion 43. Each of the fasteners 433 is in form of a pin.

Figure 6:
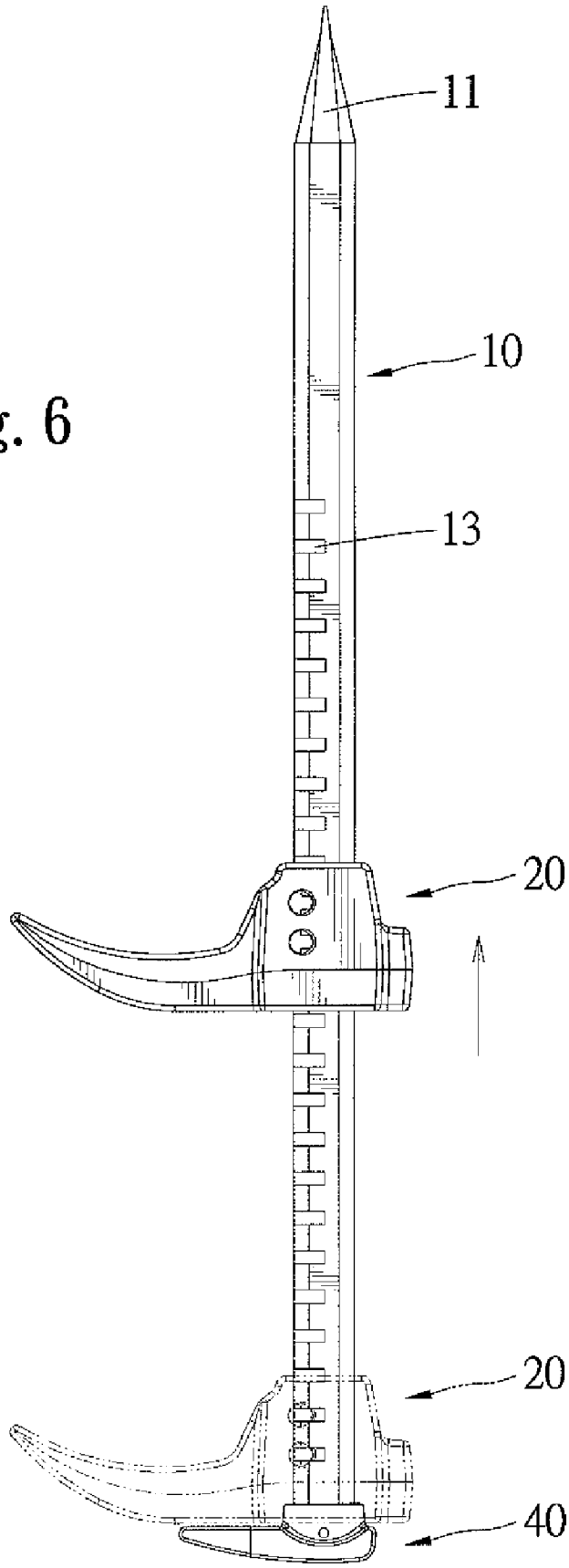
FIG. 6 is a side view of the multi-function tool shown in FIG. 1, illustrating the pry bar driven to slide along the shank body upwardly.
Figure 7:
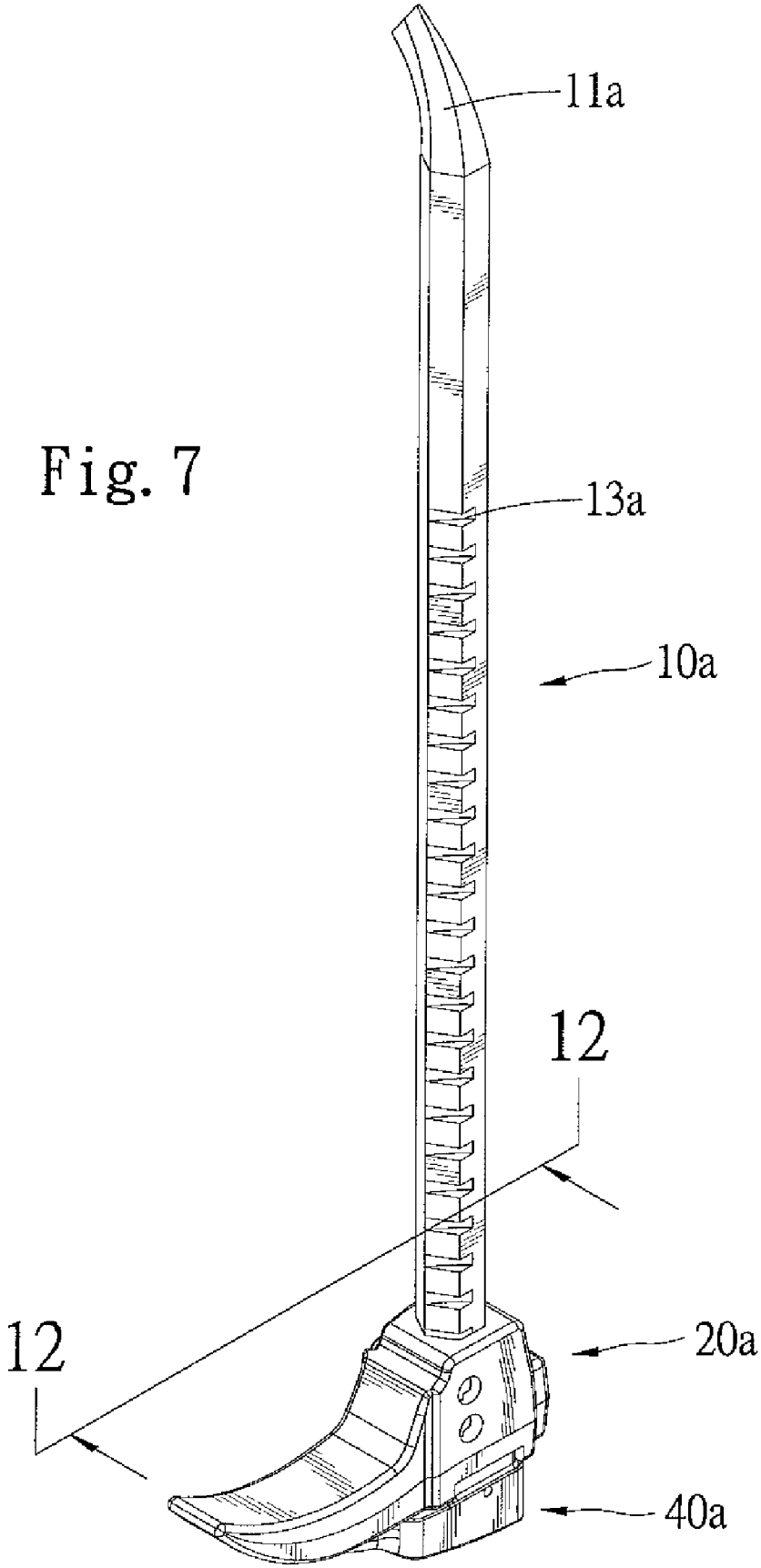
FIG. 7 is a perspective view of a multi-function tool according to the second embodiment of the present invention.
Figure 8:
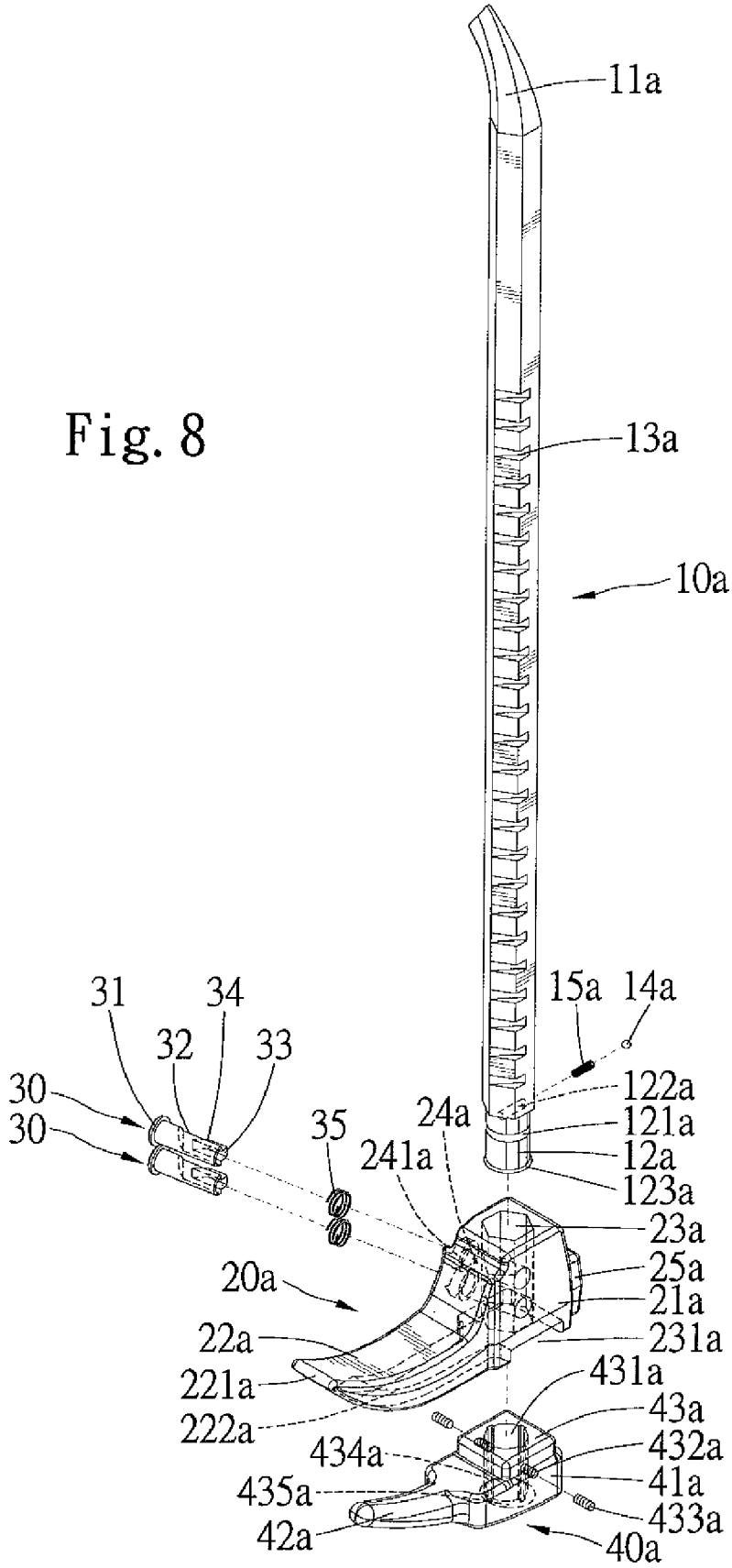
FIG. 8 is an exploded view of the multi-function tool shown in FIG. 7.
Figure 9:
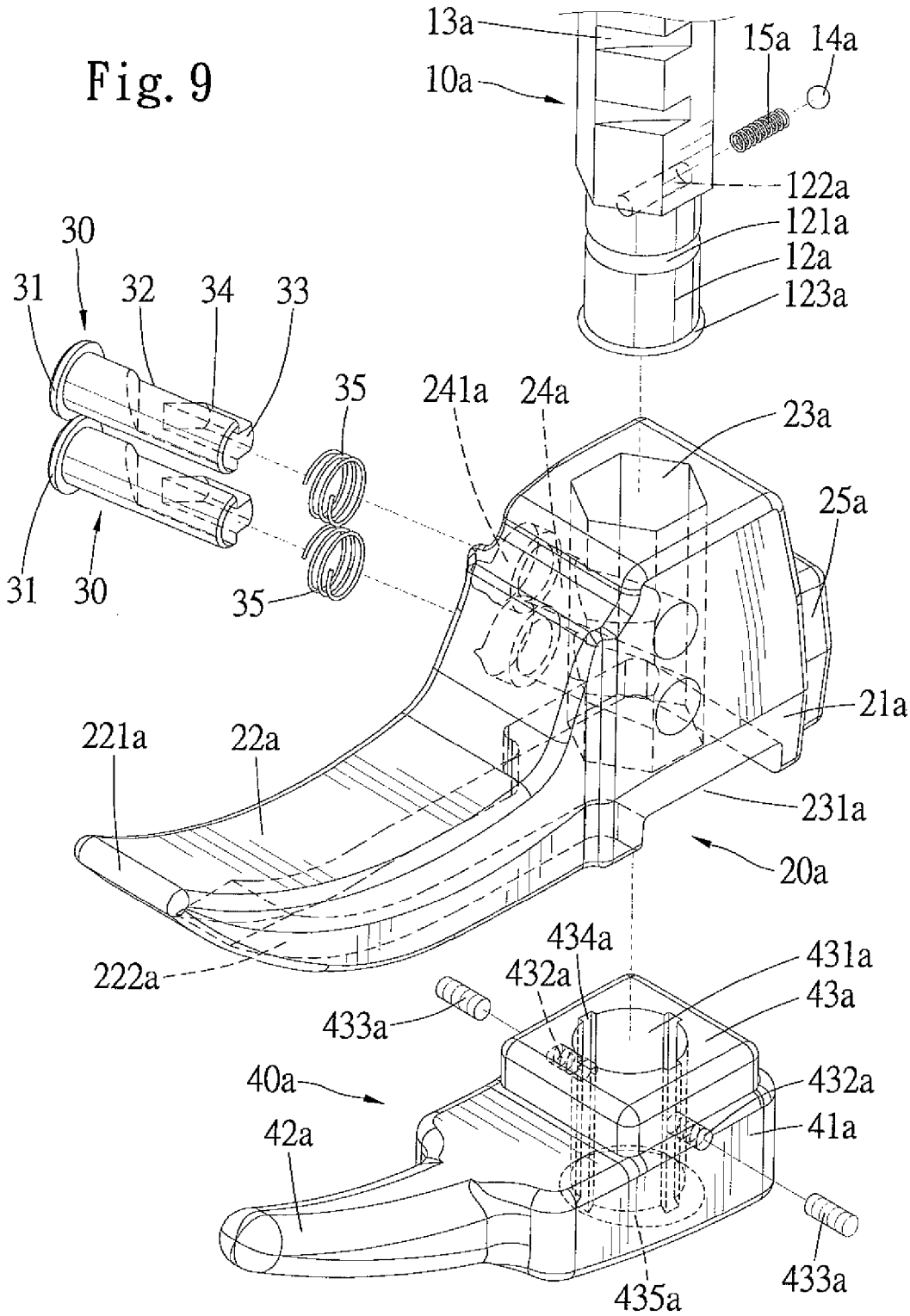
FIG. 9 is a partial enlarged view shown in FIG. 8.

Therefore, further referring to FIG. 6, while the pry bar 20 (dashed line) is fixed on the foot hold 40, the top rim of the connective portion 43 is received in the first limited end 231 of the first receptacle 23. The pry bar 20 detaches from the foot hold 40 and slides relative to the shank body 10 upwardly, when the clutch 30 is in the disengaging position; the location of the pry bar 20 on the shank body 10 is fixed when the clutch 30 is in the engaging position. And the foot hold 40 is adapted for the multi-function tool placed on the ground stably. Accordingly, as the location of the pry bar 20 on the shank body 10 is adjusted to far from the foot hold 40, the length of nails that are adapted to be pulled by the pry bar 20 could increase. Moreover, a user can grip various sizes of material by adjusting the distance between the pry bar 20 and foot hold 40.

Referring to FIGS. 6 through 14, it shows a second embodiment in the present invention which is similar to the first embodiment except several features below. Firstly, a shank body 10*a* replaces the shank body 10. The shank body 10*a* is similar to the shank body 10, but a rim 123*a* is formed on the distal end of the second end 12*a* and an aperture 122*a* is defined on the second end 12*a* in position. An element unit is received in the aperture and includes a ball 14*a* and a spring 15 which is provided between the ball 14*a* and the aperture 122*a*.

Secondly, a pry bar 20*a* replaces the pry bar 20. The pry bar 20*a* is similar to the pry bar 20, but a first limited end 231*a* replaces the first limited end 231, with the shape of the first limited end 231*a* being square, with the first limited end 231 a further being open to a side of the first section 21*a*. A receiving portion 222*a* is further defined on the bottom of the second section 22*a* and communicating with the first limited end 231*a*, with the shape of the receiving portion 222*a* being preferably long and narrow.

Thirdly, a foot hold 40*a* replaces the foot hold 40. The foot hold 40*a* includes a first section 41*a* and a second section 42*a* opposite to the first section 41*a*. A connective portion 43*a* is formed on the first section 41*a* and includes a compartment 431*a* piercing the connective portion 43*a* and the first section 41*a*, two openings 432*a* formed on the outer periphery thereof between the first section 41*a* and the connective portion 43*a* and corresponding to the engaging groove 121*a* and two fasteners 433*a*, each provided to insert through the related one of the openings 432*a* for engaging with the engaging groove 121*a* as to couple the foot hold 40*a* to the second end 12*a* of the shank body 10*a*. Each of the fasteners 433*a* is in form of a bolt. Each of the apertures 432*a* has inner threads.

A limited end 435*a* is formed on the bottom of the compartment 431*a* and adapted for receiving the rim 123*a* of the second end 12*a*. Four located portions 434*a* are provided on the inner periphery of the compartment 431*a*, with each of the located portions 434*a* in communication with the limited end 435*a*, with the located portions 434*a* quartering the inner circumference of the compartment 431*a*. The second section 42*a* is in form of a tapered end and able to be received in the receiving portion 222*a* of the second section 22*a*.

In this embodiment, the shape of the connective portion 43*a* corresponds to that of the first limited end 231*a*; accordingly, to install the foot hold 40*a* to the pry bar 20*a*, the connective portion 43*a* should slide along the first limited end 231*a* transversely from the open side of the first section 21*a*.

Figure 10:
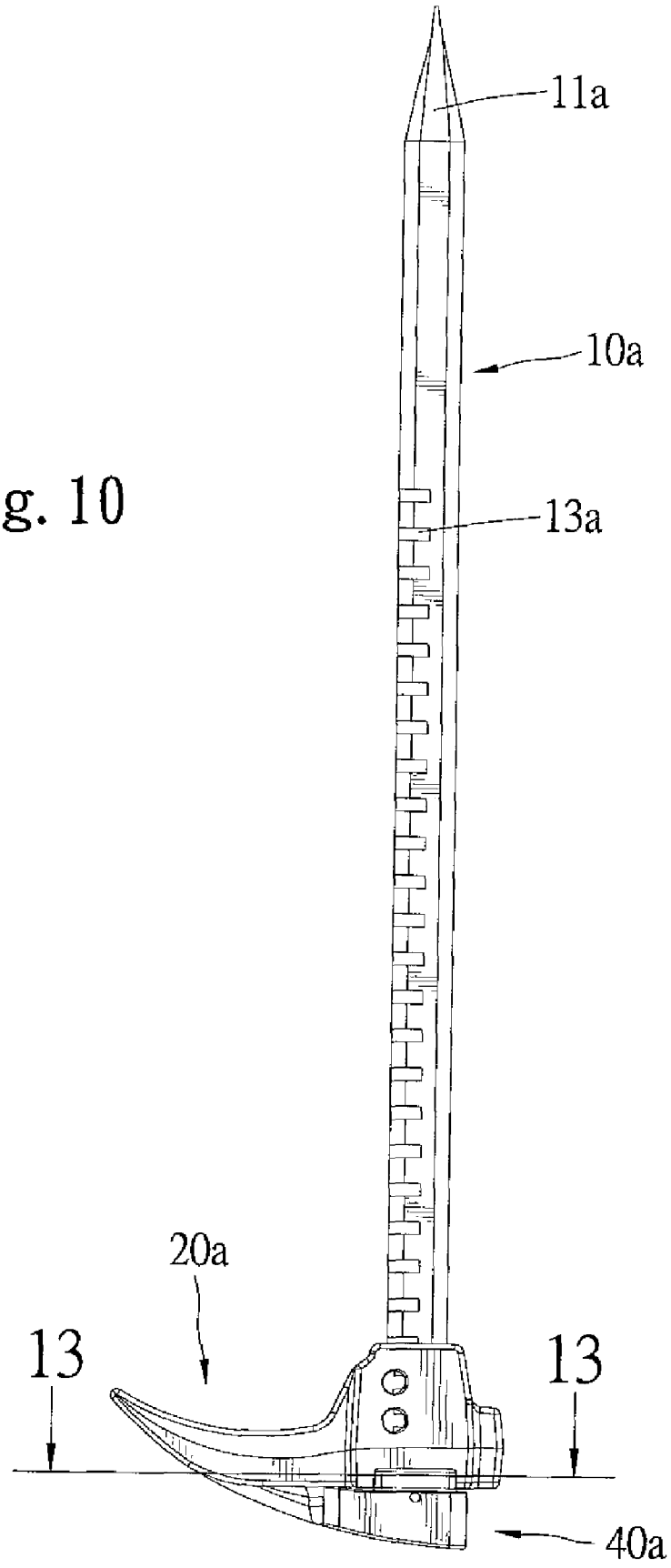
FIG. 10 is a side view of the multi-function tool shown in FIG. 7.
Figure 12:
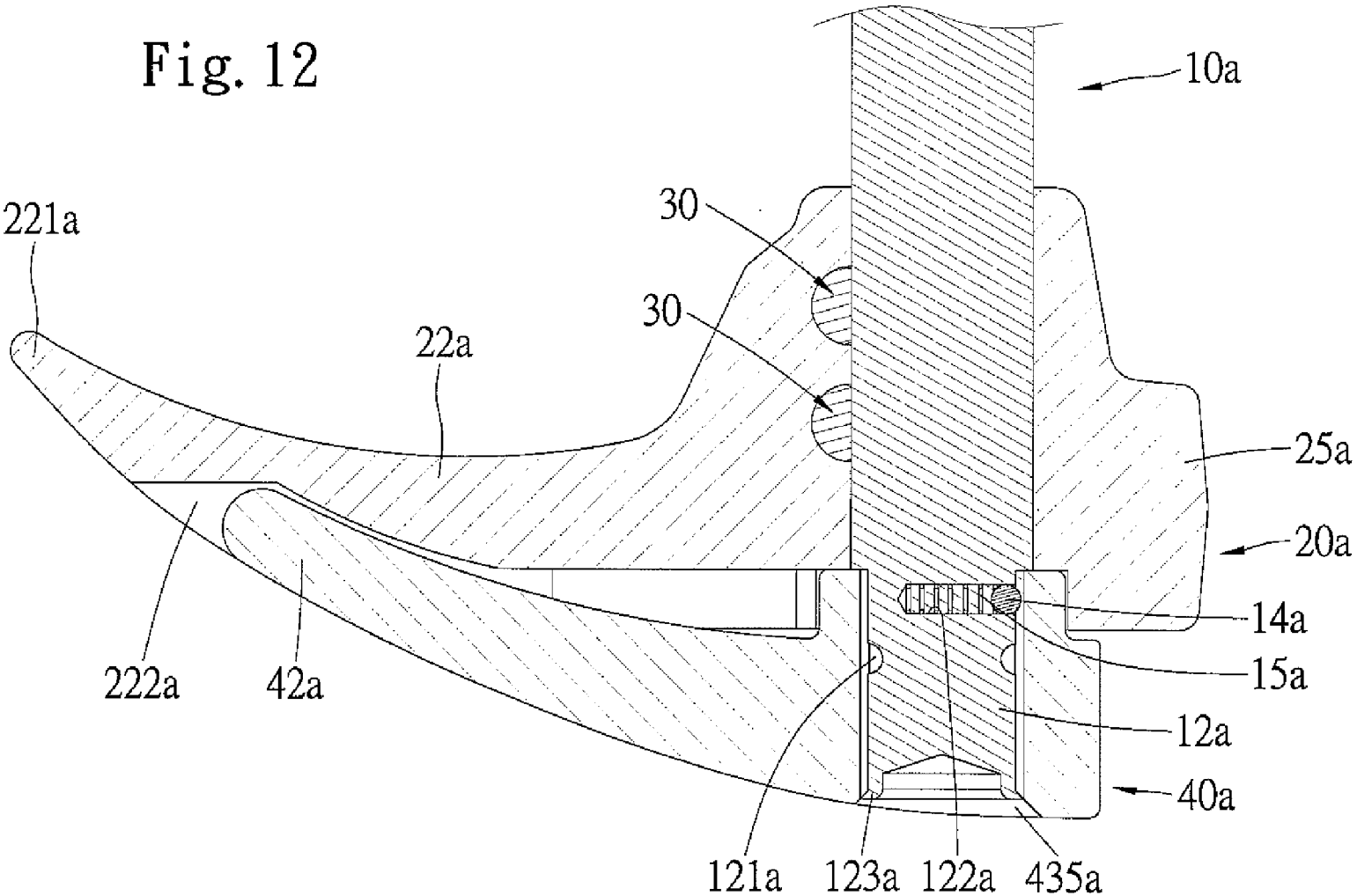
FIG. 12 is a cross-sectional view taken along 12-12 in FIG. 7.
Figure 13:
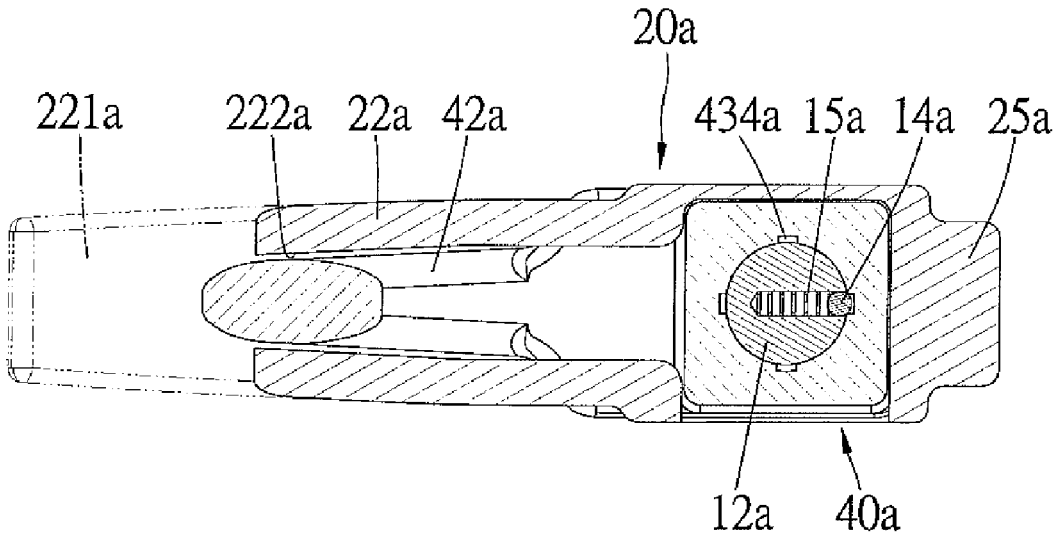
FIG. 13 is a cross-sectional view taken along 13-13 in FIG. 10.

Referring to FIGS. 10, 12 and 13, while the pry bar 20*a* is fixed on the foot hold 40*a*, the second end 12*a* is inserted into the compartment 431*a* and the rim 123*a* of the second end 12*a* is engaged with the limited end 435*a*; meanwhile, the fasteners 433*a* engage with the engaging groove 121*a* respectively (not shown) and the ball 14*a* is outwardly pressed by the spring 15*a* as to slightly project from the aperture 122*a* to one of the located portions 434*a* for engaging the foot hold 40*a* with the shank body 10*a* in position. As the foot hold 40*a* is in this position, the direction of axis the second section 42*a* of the foot hold 40*a* is parallel to that of the second section 22*a* of the pry bar 20*a*, and the second section 42*a* is disposed in the receiving portion 222*a*.

Figure 11:
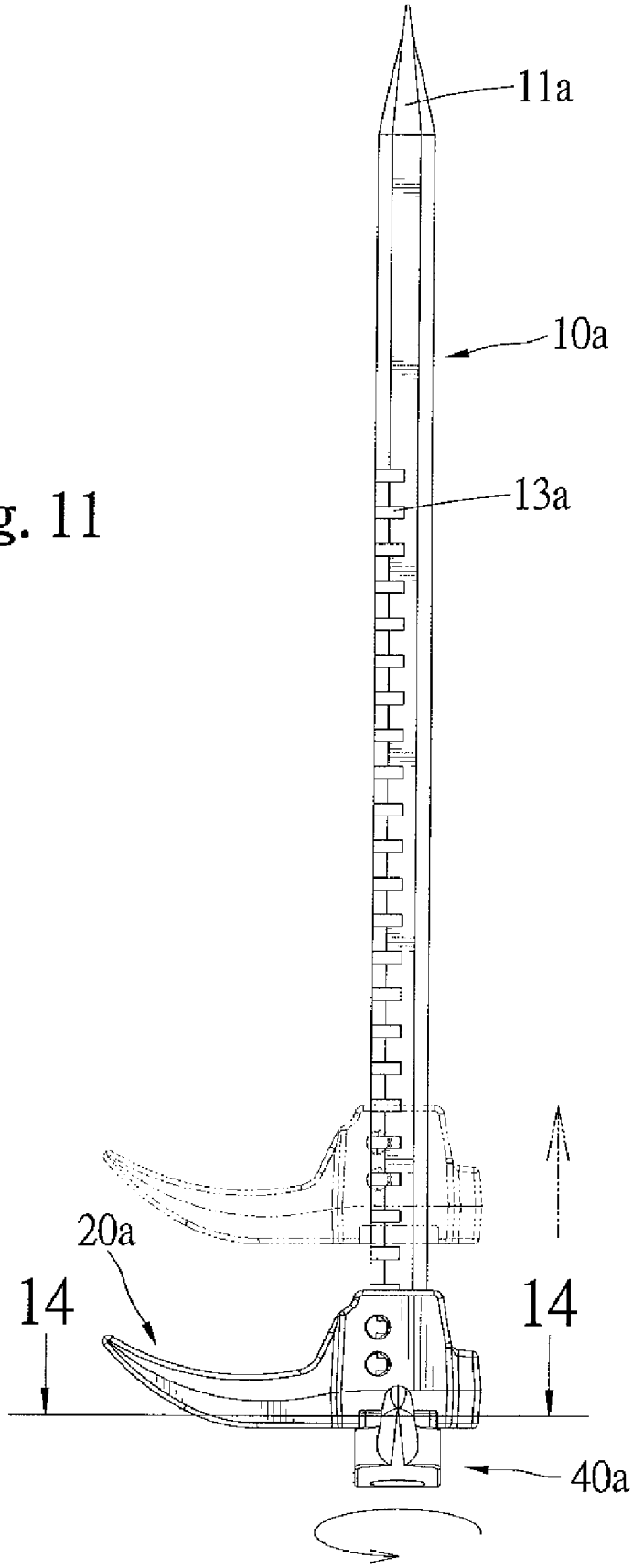
FIG. 11 is another side view similar to FIG. 10, illustrating the pry bar detaching from the foot hold and driven to slide along the shank body upwardly and then the foot hold rotating relative to the pry bar counterclockwise.
Figure 14:
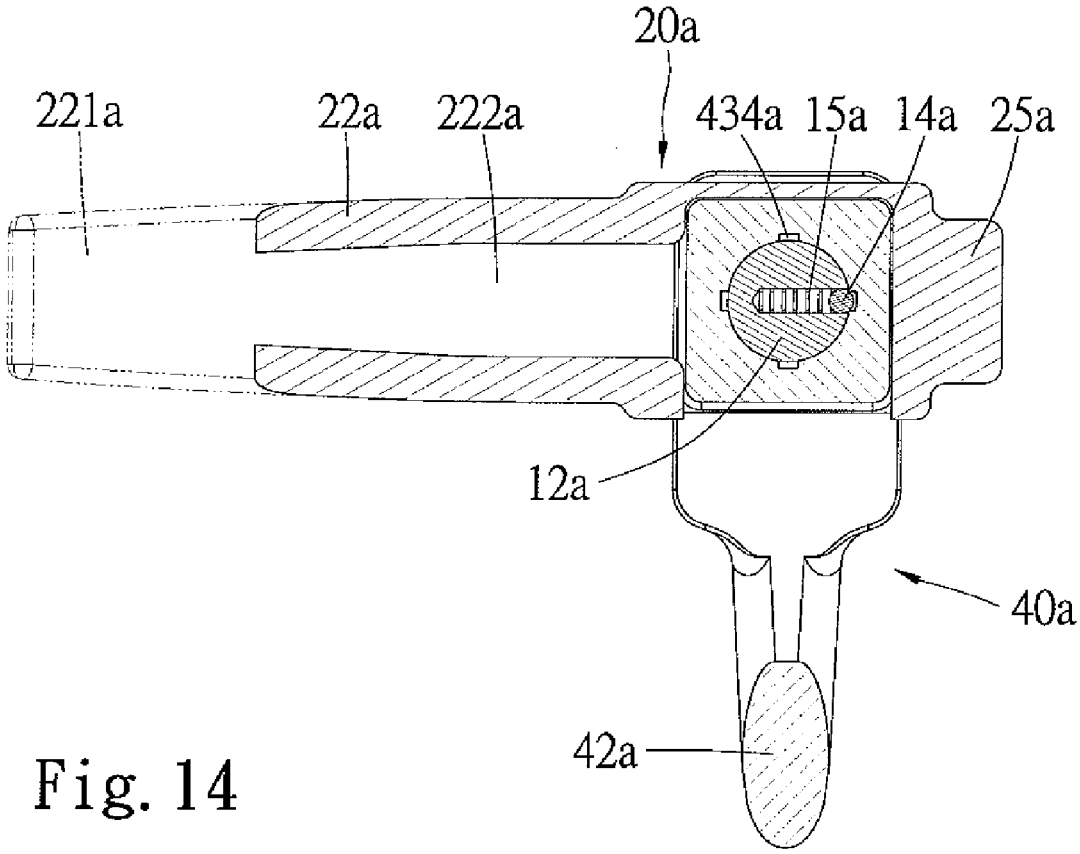
FIG. 14 is a cross-sectional view taken along 14-14 in FIG. 11.

Referring to FIGS. 11 and 14, it shows that the pry bar 20*a* is lifted to slide along the shank body 10*a*, and then the foot hold 40*a* is detached from the pry bar 20*a* and is rotated relative to the shank body 10*a* counterclockwise. To rotate the foot hold 40*a* relative with the shank body 10*a*, the pry bar 20*a* should be lifted slightly from the foot hold 40*a* firstly, and then the connective portion 43*a* is disengaged from the first limited end 231*a* so that the second section 42*a* of the foot hold 40*a* can be away from the receiving portion 222*a* of the pry bar 20*a*. Finally, the pry bar 20*a* can be returned to fix to the foot hold 40*a* or slide along the shank body 10*a* alternatively.

While the foot hold 40*a* is being rotated relative with the shank body 10*a*, the ball 14*a*, which is originally engaged with the one of the located portions 434*a*, is displaced and pushed to press the spring 15*a* by the inner wall of the compartment 431*a*. Therefore, the ball 14*a* is pushed into the aperture 122*a* of the shank body 10*a* and the spring 15*a* is pressed. Subsequently, the ball 14*a* contacts with the other one of the located portions 434*a* as the foot hold 40*a* is rotated to a desired position, and the ball 14*a* is pressed outwardly by the spring 15*a* again and slightly projects from the aperture 122*a* of the shank body 10 so that the foot hold 40*a* is fixed to the shank body 10*a* in this position via engagement of the ball 14*a* and the other one of the located portions 434*a*. In these drawings, the direction of axis of the second section 42*a* of the foot hold 40*a* is perpendicular to that of the second section 22*a* of the pry bar 20*a*.

Furthermore, the foot hold 40*a* can be rotated relative to the shank body 10*a* clockwise or counterclockwise, and the ball 14*a* of the shank body 10*a* is selectively engaged with the four located portions 434*a* so that the foot hold 40*a* can be rotated to four positions with respect to the shank body 10*a*. Except for the two positions that are discussed in the above, the foot hold 40*a* can be rotated to two positions. In one of the two positions, the direction of axis of the second section 42*a* of the foot hold 40*a* is parallel to that of the second section 22*a* of the pry bar 20*a*; however, the second section 42*a* is disengaged from the receiving portion 222*a*. In another one of the two positions, the direction of axis of the second section 42*a* of the foot hold 40*a* is perpendicular to that of the second section 22*a* of the pry bar 20*a*; however, the direction of axis of the second section 42*a* is opposite to that is shown in FIGS. 11 and 14.

What is claimed is:

1. A multi-function tool comprising:

a shank body including a first end, a second end opposite to the first end and a plurality of located grooves formed thereon and longitudinally aligned between the first and second ends thereof;

a pry bar including a first section, a second section for prying, a first receptacle longitudinally piercing the first section and adapted for the second end of the shank body inserted therethrough and at least one of second receptacles transversely piercing the first section and in communication with the first receptacle;

at least one of clutches respectively disposed in the second receptacles for alternatively engaging with a selective one of the located grooves of the shank body as to fix the pry bar to the shank body in position; and a foot hold disposed onto the bottom of the first receptacle;

wherein the second end of the shank body is inserted through the first receptacle of the pry bar and installed to the foot hold, with the foot hold being able to rotate relative to the shank body.

2. The multi-function tool as claimed in claim 1 wherein the foot hold further comprises a first section, a second section extending from the first section and adapted for prying and a connective portion formed on the first section for connecting to the second end of the shank body.

3. The multi-function tool as claimed in claim 2, with the second end of the shank body including an engaging groove on the outer periphery thereof, with the connective portion including a compartment for receiving the second end of the shank body, at least one of fasteners inserted through the compartment for engaging with the engaging groove of the second end of the shank body so that the shank body is installed to the foot hold rotatably.

4. The multi-function tool as claimed in claim 3, with the compartment having at least one of openings on the periphery thereof, with each of the openings adapted for receiving one of the fasteners.

5. The multi-function tool as claimed in claim 3, further comprising a first limited end defined on the bottom of the first receptacle of the pry bar for receiving the rim of the compartment of the foot hold.

6. The multi-function tool as claimed in claim 1, with each clutch including a protrusion on a side of an end thereof for exactly inserting into a selectively one of the located grooves, an abutted surface defined on the protrusion so that when the protrusion is inserted in the one of the located grooves, the abutted surface just abuts with the inner wall of the located groove for secure engagement of the pry bar and the shank body.

7. The multi-function tool as claimed in claim 6, with the clutch including a sunken portion provided on another end thereof and opposite to the protrusion so that the shank body can insert through the clutch and is set in the first receptacle of the pry bar without contact with the clutch.

8. The multi-function tool as claimed in claim 6, with the clutch including a flange on the terminal end thereof adjacent to the sunken portion, with each of the second receptacles including a second limited end for receiving the flange of the clutch, with the diameter of the second limited end being larger than that of the second receptacle.

9. The multi-function tool as claimed in claim 7, with the clutch further including an elastic element; wherein when the clutch is in an engaging position and the elastic element is released, the protrusion is engaged with one of the located grooves and the abutted surface abuts with the inner wall of the located groove; wherein when the clutch is a disengaging position and the elastic element is pressed, the protrusion is disengaged from the located groove and the abutted surface is spaced from the inner wall of the located groove.

10. The multi-function tool as claimed in claim 1, with the interval between each of the located grooves alternatively being constant or not.

11. The multi-function tool as claimed in claim 1, with the second section of the pry bar having a prying portion, with the cooperation of the prying portion and the second section of the foot hold adapted for clamping materials with various sizes.

12. The multi-function tool as claimed in claim 3, with each of the fasteners being in form of a pin.

13. A multi-function tool comprising:

a shank body including a first end, a second end and a plurality of located grooves longitudinally aligned between the first and second ends thereof;

an elastic unit provided in the second end of the shank body;

a pry bar including a first receptacle longitudinally piercing therethrough for slidably receiving the shank body and at least one of second receptacles transversely piercing therethrough and in communication with the first receptacle;

at least one clutches respectively disposed in the second receptacles for alternatively engaging with a selective one of the located grooves of the shank body as to fix the pry bar to the shank body in position; and a foot hold including a compartment for receiving the second end of the shank body and several located portions provided on the inner periphery of the compartment;

wherein when the elastic unit is engaged with a selectively one of the located portions and slightly projects from the second end of the shank body, the foot hold is fixed relative to the shank body in a desired position;

wherein when the elastic unit is disengaged from the located portion and pressed to be drawn into the second end of the shank body, the foot hold is able to rotate relative to the shank body.

14. The multi-function tool as claimed in claim 13, wherein the foot hold further comprises a first section, a second section extending from the first section and adapted for prying and a connective portion formed on the first section, with the compartment piercing the first section longitudinally.

15. The multi-function tool as claimed in claim 14, with the second end, of the shank body including an engaging groove on the outer periphery thereof, an aperture for receiving the elastic unit and a rim formed on the distal end thereof, with the connective portion including a limited end formed on the bottom of the compartment for disposing the rim of the second end, at least one of fasteners inserted through the first section for engaging with the engaging groove of the second end of the shank body so that the shank body is installed to the foot hold rotatably.

16. The multi-function tool as claimed in claim 15, with the compartment having at least one of openings on the periphery thereof, with each of the openings adapted for receiving one of the fasteners.

17. The multi-function tool as claimed in claim 14, further comprising a first limited end defined on the bottom of the first receptacle of the pry bar for receiving the connective portion of the foot hold.

18. The multi-function tool as claimed in claim 17, with the pry bar including a receiving portion formed on the bottom of the second section thereof, with the foot hold including a second section; wherein the second section is able to be received in the receiving portion of the pry bar.

19. The multi-function tool as claimed in claim 14, with the connective portion being square.

20. The multi-function tool as claimed in claim 13, with the clutch including a protrusion on a side of an end thereof for exactly inserting into a selectively one of the located grooves, an abutted surface defined on the protrusion so that when the protrusion is inserted in the one of the located grooves, the abutted surface just abuts with the inner wall of the located groove.

21. The multi-function tool as claimed in claim 20, with the clutch including a sunken portion provided on another end thereof and opposite to the protrusion so that the shank body can insert through the clutch and is set in the first receptacle of the pry bar without contact with the clutch.

22. The multi-function tool as claimed in claim 21, with the clutch including a flange on the terminal end thereof adjacent to the sunken portion, with each second receptacle including a second limited end for receiving the flange of the clutch, with the diameter of the second limited end being larger than that of the second receptacle.

23. The multi-function tool as claimed in claim 20, with the clutch further including an elastic element; wherein when the clutch is in an engaging position and the elastic element is released, the protrusion is engaged with one of the located grooves and the abutted surface abuts with the inner wall of the located groove; wherein when the clutch is in a disengaging position and the elastic element is pressed, the protrusion is disengaged from the located groove and the abutted surface is spaced from the inner wall of the located groove.

24. The multi-function tool as claimed in claim 13, with the interval between each of the located grooves alternatively being constant or not.

25. The multi-function tool as claimed in 13, with the second section of the pry bar having a prying portion, with the cooperation of the prying portion and the second section of the foot hold adapted for clamping materials with various sizes.

* * * * *